US009266361B2

(12) United States Patent
Plaia et al.

(10) Patent No.: US 9,266,361 B2
(45) Date of Patent: Feb. 23, 2016

(54) METHOD AND DEVICE FOR PROVIDING A SUBSTRATE WITH AN IMPRINT AND WITH A TRANSFER COATING, AND FINISHED SUBSTRATE

(71) Applicant: LEONHARD KURZ Stiftung & Co. KG, Furth (DE)

(72) Inventors: Ulrike Plaia, Veitsbronn (DE); Klaus Pforte, Oberasbach (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 0 days.

(21) Appl. No.: 14/412,124

(22) PCT Filed: Jun. 14, 2013

(86) PCT No.: PCT/EP2013/062418

§ 371 (c)(1),
(2) Date: Dec. 30, 2014

(87) PCT Pub. No.: WO2014/005823

PCT Pub. Date: Jan. 9, 2014

(65) Prior Publication Data

US 2015/0145936 A1 May 28, 2015

(30) Foreign Application Priority Data

Jul. 2, 2012 (DE) ..... 10 2012 105 854

(51) Int. Cl.

| | |
|---|---|
| ***B41J 2/01*** | (2006.01) |
| ***B41J 11/00*** | (2006.01) |
| ***B41F 19/00*** | (2006.01) |
| ***B41J 2/005*** | (2006.01) |

(52) U.S. Cl.
CPC ..... *B41J 11/002* (2013.01); *B41F 19/002* (2013.01); *B41J 2/0057* (2013.01); *B42D 2033/10* (2013.01); *B42D 2035/20* (2013.01)

(58) Field of Classification Search
CPC ..... B41J 2/325; B41J 2/32
See application file for complete search history.

(56) References Cited

U.S. PATENT DOCUMENTS

| | | | |
|---|---|---|---|
| 4,340,438 | A | 7/1982 | Davis |
| 2008/0079769 | A1 | 4/2008 | Yahiro |
| 2010/0065193 | A1 | 3/2010 | Puschel et al. |

FOREIGN PATENT DOCUMENTS

| | | | | |
|---|---|---|---|---|
| DE | 102006060830 | | 6/2008 | |
| DE | 102009040359 | | 3/2011 | |
| EP | 1719622 | | 4/2013 | |
| JP | 2001038887 | A * | 2/2001 | ..... B41F 13/193 |
| JP | 2009226863 | | 10/2009 | |
| JP | 2011093198 | | 5/2011 | |
| WO | WO 93/07000 | | 4/1993 | |
| WO | WO 96/31808 | | 10/1996 | |
| WO | WO 01/17796 | | 3/2001 | |

* cited by examiner

*Primary Examiner* — Lisa M Solomon
(74) *Attorney, Agent, or Firm* — Hoffmann & Baron, LLP

(57) ABSTRACT

In a method for providing a substrate with an imprint, in which liquid printing ink is first printed on a strip and there made to dry at least partially, and in which the at least partially dried printing ink is transferred from the strip (B) to the substrate (S), in addition to the printing ink a transfer coating (F), in particular a decorative transfer coating, is also applied to the substrate (S). In particular, the transfer coating (F) can likewise be applied to the strip (B) first and transferred from the strip (B) to the substrate (S). Printing ink can be provided on the strip (B) next to, but also under or over the transfer coating.

22 Claims, 7 Drawing Sheets

METHOD AND DEVICE FOR PROVIDING A SUBSTRATE WITH AN IMPRINT AND WITH A TRANSFER COATING, AND FINISHED SUBSTRATE

This application claims priority based on an International Application filed under the Patent Cooperation Treaty, PCT/EP2013/062418, filed on Jun. 14, 2013, and German Application No. DE 10201205854.7, filed on Jul. 2, 2012.

BACKGROUND OF THE INVENTION

The invention relates to a method as well as a device for providing a substrate with an imprint (in particular with printing ink). It also relates to such a substrate, provided with an imprint, which can be obtained using the method.

The starting point of the invention is a method with the following properties: Firstly, for instance with the aid of one or more inkjet print heads (e.g. inkjet technology), liquid printing ink is printed on a (transfer) strip. The printing ink is made to dry at least partially on the strip. In the case of drying, liquid (water, solvent) escapes from the printing ink, which substantially consists of this carrier liquid and pigment particles in particular dispersed therein, in particular with diameters of between 20 and 100 nm. In the case of partial drying, residual liquid remains in the printing ink. The partial drying is brought about in particular by heating the strip. The printing ink which is liquid when it exits the inkjet print head (low viscosity) changes here into a more solid paste (high viscosity) on the strip. In a subsequent step the at least partially dried printing ink, thus the paste, is moved from the strip to the substrate or transferred to the substrate.

The method makes it possible to print particularly small structures, in particular dot structures, in the range of between 5 μm and 50 μm in diameter. In particular, the printing ink does not run on the substrate, because it is already dried on the strip beforehand to form a highly viscous material.

A method on which the present method draws is described in WO 96/31808 A1. There, instead of a (transfer) strip to which the liquid printing ink is applied and on which it is dried, a corresponding roller is provided.

An offset printing machine is known from EP1 719 622 A2, in which a phase change ink is applied to a transfer apparatus of the printing machine and transferred to a substrate by means of this.

WO 93/07000 describes an inkjet printing system in which, by means of a print head, ink is applied to a transfer roller and transferred to a substrate by means of this.

DE 10 2009 040 359 A1 describes a method in which an adhesive layer is applied to a substrate, which is then provided with a film transfer layer.

SUMMARY OF THE INVENTION

The object of the present invention is to broaden the possibilities that the named printing method offers and to create new articles in this connection.

The object is achieved in one aspect by a method for providing a substrate with an imprint, in which liquid printing ink is first printed on a strip and there made to dry at least partially, and in which the at least partially dried printing ink is transferred from the strip to the substrate, wherein in addition to the printing ink a transfer coating, in particular a decorative transfer coating, is also applied to the substrate. The transfer coating is in particular a transfer layer of a transfer film, wherein the transfer film has a carrier film to which the transfer layer is detachably fixed. The transfer coating is thus detached from the carrier film and applied to a surface by means of a transfer method. In the present case this surface is either the substrate or the strip.

By a transfer coating, the substrate can be given, for one thing, a particular, in particular optical, surface property or also given other particular (e.g. mechanical and/or electrical) properties. In particular in the case of a decorative transfer coating, the appearance of the substrate can also be influenced independently of the printing ink used. For example, a single-color decorative transfer coating in a yellow color can bring about the effect of a yellow background for the image provided by the printing ink. A transfer coating with a reflective metal such as for example aluminum, chromium, nickel, copper, gold or silver creates a background with a silver gloss or other metallic gloss. The transfer coating can also have a transparent, reflective layer, e.g. layers with a high refractive index, so-called HRI layers (HRI=High Refractive Index), whereby a slightly reflective, shimmering background is generated. The above-named reflective layers can preferably be combined with diffractive or refractive surface reliefs.

In a preferred first variant of the method according to the invention, the transfer coating is applied to the strip first and then transferred from the strip to the substrate. If the transfer coating is applied in one go using the printing process of printing the liquid printing ink on the strip, the transfer coating can be applied to the strip and thus, ultimately, to the substrate particularly well in a predetermined positional relationship (in particular register-accurate). Precisely when a predetermined pattern which is to be in a particular positional relationship to the image provided by the printing ink on the finished substrate is provided by the transfer coating, it is advisable to apply the transfer coating to the strip first.

In order to apply the transfer coating to the strip, a curable adhesive (in particular an adhesive that can be cured with ultraviolet light or with another energy-rich radiation) is preferably printed on the strip. For the printing technique, it is possible here to draw on the techniques for applying liquid printing ink, for example an inkjet print head can be used. After the curable adhesive has been printed on the strip, the transfer film is then applied to the adhesive and the adhesive is cured (for instance by supply of ultraviolet light). After the adhesive has cured, the carrier film is peeled off the transfer layer or transfer coating fixed to the strip by means of adhesive. By means of the adhesive, therefore, the transfer coating adheres to the strip, with the result that its position on the strip is fixed, in particular also relative to the position of imprints with the liquid printing ink. Particularly preferably, a further layer of adhesive or a further layer of printing ink is then also applied to the transfer coating, wherein this adhesive or this printing ink then serves to effect an adhesion of the transfer coating to the substrate, to which the transfer coating is then transferred.

The adhesive, in particular the UV-curable adhesive, preferably comprises a polyfunctional alkoxylated or a polyalkoxylated acrylate monomer as well as a photoinitiator. For example the photoinitiator Irgacure® 369 from BASF, Ludwigshafen, is suitable as photoinitiator.

Such an adhesive can be printed particularly well and, in fact, effects a good adhesion of the transfer coating to the strip on the one hand, while on the other hand this adhesive is also removed from the strip again without difficulty.

The printing ink and/or the adhesive can be printed such that the printed layer forms a continuous homogeneous and coherent layer in a particular surface pattern or predetermined layout on the strip or, later, on the substrate.

By means of a transfer coating which contains a metallic layer, for example conductive traces, antenna conductive traces, touch sensor conductive traces or other conductive elements can thus be transferred to the strip or the substrate, with the result that electrical functional components are provided.

By means of a transfer coating which has several electrical/electronic functional layers, for example conductive and/or semiconductive layers, electronic functional components can be transferred completely or only in parts to the strip or the substrate.

By means of a transfer coating which has one or more optical functional layers, for example diffractive and/or refractive surface reliefs, optically variable pigments or dyes, polarization layers, fluorescent and/or phosphorescent layers, hologram layers, volume hologram layers or similar, optical functional components provided in this way, e.g. as protection against forgery, can be transferred completely or only in parts to the strip or the substrate.

The printing ink and/or the adhesive can also be printed in a grid of grid elements, in particular grid points. The size of the grid elements and/or the grid width of the grids of the printing ink and the adhesive can be identical and generate a common total grid image. However, the size of the grid elements and/or the grid width of the grids of the printing ink and the adhesive can also be different. For example the grid width and/or the size of the grid elements of the adhesive can be smaller or larger thus the grid width and/or the size of the grid elements of the printing ink. The transfer coating could thus be present in a finer or coarser grid than the printing ink and thus generate specific optical effects.

It can be provided that the transfer coating is applied to the strip after a first printing process in which printing ink is printed on the strip. If the transfer coating is regarded as an "addition" to the printing ink image, the result of it is to apply this transfer coating after the printing ink. Here, for one thing, the transfer coating can be applied next to the printing ink, thus in areas which do not overlap with the areas of the application of the printing ink. The transfer coating can equally well also be applied such that it covers the printing ink in first areas. If the entirety is then transferred to a substrate, the transfer coating comes to lie underneath the printing ink and can provide a background effect for the printing ink image. Depending on what opacity the printing ink has, the transfer coating can in particular be visible partially through the printing ink and the color of the transfer coating, with the color of the printing ink, can bring about an additional color effect or another optical effect.

Alternatively or in addition, the transfer coating is applied to the strip before a second printing process in which printing ink is printed on the strip. The second printing process is only identified separately here, and carrying it out does not necessarily require that the first printing process is carried out at the same time.

In this embodiment it is of primary importance that the transfer coating is to be provided on the finished substrate in an upper area of the surface. In the second printing process the printing ink can be printed next to the transfer coating, i.e. the areas of the printing ink imprint do not overlap with those of the transfer coating. In particular, however, in the second printing process the printing ink can also be printed such that it covers the transfer coating in second areas. In this case, the transfer coating comes to lie uppermost on the finished substrate and covers the printing ink areas. It is thereby possible both to effect a protection of the printing ink on the finished substrate and to achieve a particular aesthetic effect. For example a metallically reflective transfer coating can cover the printing ink.

In a second variant of the invention the transfer coating is applied to the substrate before the transfer of the printing ink. Here, known techniques for applying transfer coating to other articles, such as for example a paper substrate, etc., can be drawn on. The transfer of the at least partially dried printing ink to the substrate thus takes place either directly on the transfer coating and/or in areas between areas with the transfer coating. The printing ink can be formed such that it adheres particularly well to the transfer coating. Particular aesthetic effects can also be achieved if the printing ink adheres to the transfer coating itself and/or alternatively in areas between transfer coating areas.

In this variant, in a continuous process the transfer coating is preferably applied to the substrate, then the substrate is guided to the strip and the at least partially dried printing ink is transferred. (Alternatively, it is possible to transfer the transfer coating to the substrate in any work step and only later to use the substrate in conjunction with the application of the imprint in another corresponding device).

According to a further aspect of the invention a device is provided for providing a substrate with an imprint, wherein this device has a strip, an apparatus for printing liquid printing ink on the strip, and an apparatus for guiding the substrate to the strip in order to transfer printing ink from the strip to the substrate. Finally, an apparatus is provided for applying a transfer coating to the strip. With the device according to the invention the method can be realized in its first variant, and the advantages named above in this regard also apply to the operation of the device.

The apparatus for applying a transfer coating preferably comprises:

- an apparatus for printing a first UV-curable adhesive on the strip, and/or
- a film-feeding apparatus and/or a residual film winding apparatus and/or
- an ultraviolet lamp or another energy-rich radiation source for curing the first adhesive and/or
- an apparatus for printing a second adhesive on the strip.

In a further aspect of the invention a device is provided for providing a substrate with an imprint, which device has a strip, an apparatus for printing liquid printing ink on the strip and an apparatus for guiding the substrate to the strip in order to transfer printing ink from the strip to the substrate, wherein finally an apparatus upstream of the apparatus for guiding the substrate relative to the transport direction of the substrate is also provided for applying a transfer coating to the substrate. With this device, the method according to the second variant of the invention can be realized, and the advantages named there apply correspondingly to the operation of the device.

In the devices named until now, the strip can preferably be heated in order to effect an at least partial drying of the printing ink. The drying of the printing ink can be actively encouraged here.

According to a further aspect of the invention a substrate provided with an imprint using the method according to one of claims 1 to 15 is provided which at least partially comprises a transfer coating, in particular a decorative transfer coating.

The printing method which is the starting point of the invention makes quite particular types of printing on a substrate possible. If another transfer coating is additionally provided here, quite novel articles with increased resistance to wear and damage and with improved aesthetic effects and/or functional properties can be realized.

In the case of the substrate, printing ink can be located on and/or under the transfer coating, and quite novel aesthetic effects can be achieved here. The transfer coating can comprise a decorative layer, a metallic layer or another layer for providing an electrical functional component and/or one or more optical functional components.

BRIEF DESCRIPTION OF THE DRAWINGS

The invention is described in more detail below with reference to the drawing, in which.

DETAILED DESCRIPTION OF THE INVENTION

In the present case a substrate labeled S as a whole, for example a paper web, is to be provided with an imprint. In the method used for this, printing ink is not printed directly on the substrate S, but first on a strip B. The substrate is guided over rollers R and reaches a contact point KT, at which the printing ink is transferred from the strip B to the substrate S.

Figure 1:
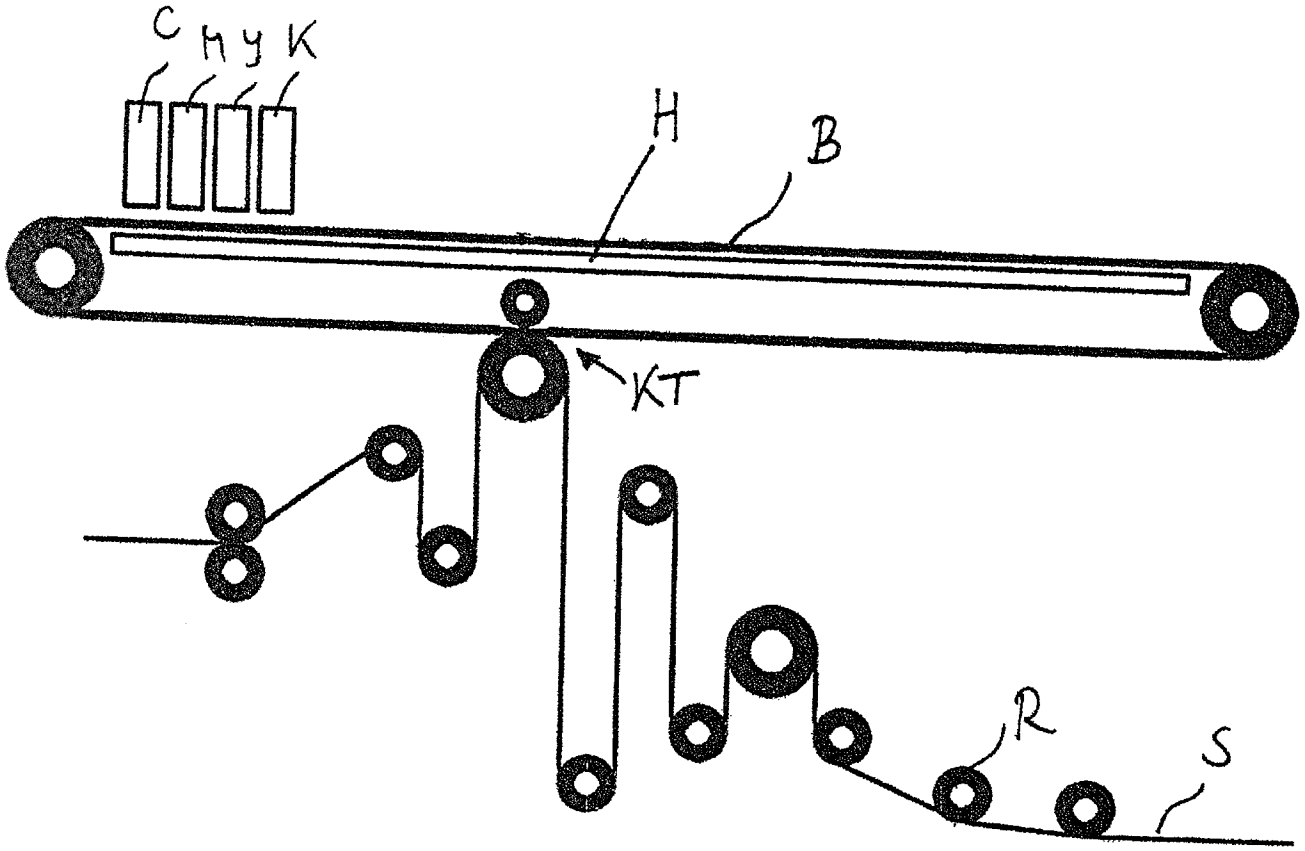
FIG. 1 shows a device for providing a substrate with an imprint in a basic arrangement in a schematic sectional representation.

FIG. 1 shows a basic arrangement. This comprises four inkjet printer units C, M, Y and K, which print four different colors (C=cyan, M=magenta, Y=yellow and K=black) which can be mixed to form all possible colors. The strip B can be heated, symbolized in FIG. 1 by a heating loop H. The heating can also be provided inside the strip by a fine network of heating wires. The strip can consist of silicone or rubber (with or without fiber reinforcement) or of a particularly solid plastic material. The strip B can equally well also have metal parts which can be heated directly. The surface of the strip B is such that, on the one hand, the printing ink printed by the inkjet printer units C, M, Y and K adheres well to the surface, but, on the other hand, that it detaches itself well at the contact point KT in the case of contact with the substrate S and is removed residue-free from the surface of the strip B.

Figure 2:
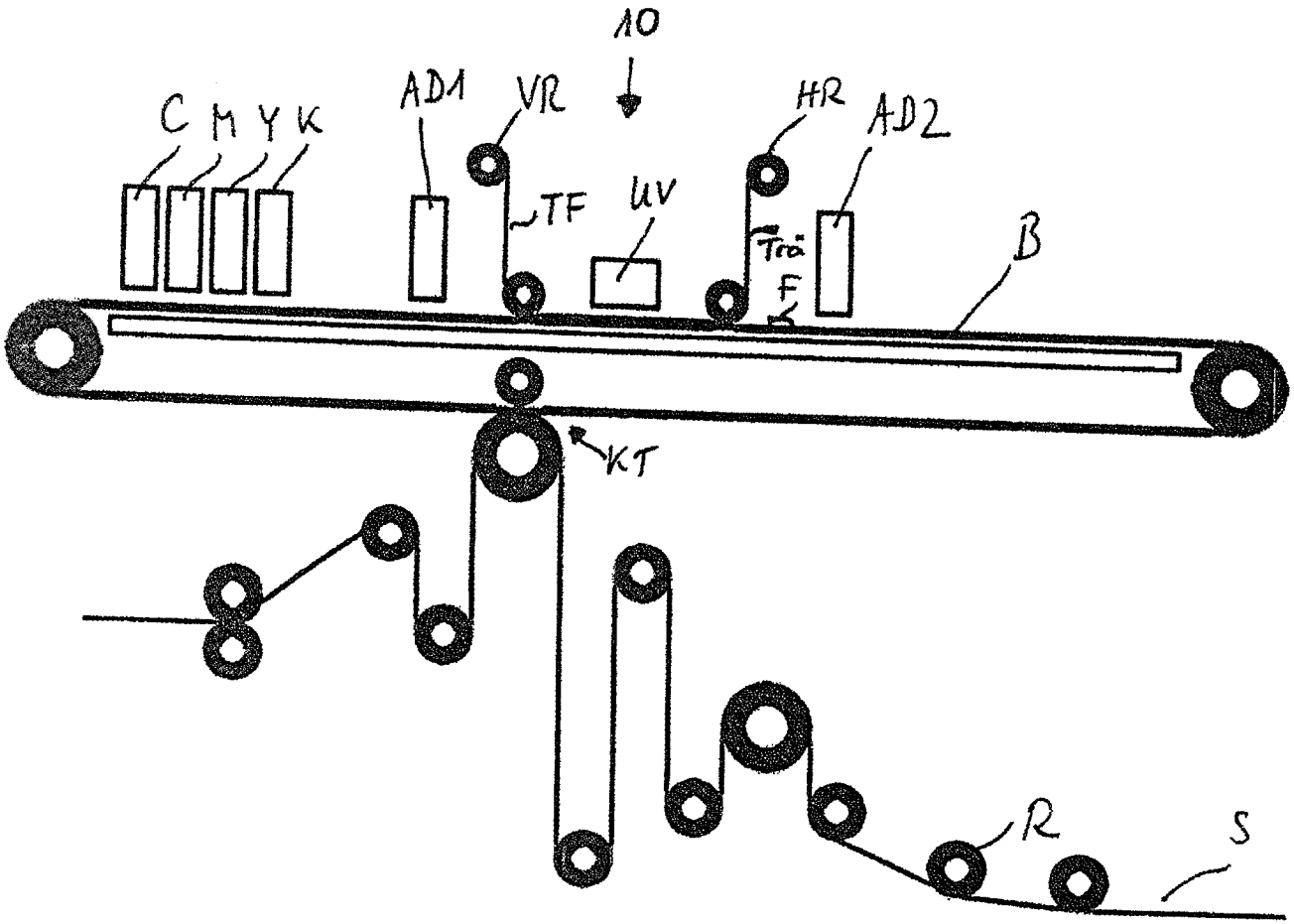
FIG. 2 shows a device for providing a substrate with an imprint according to a first aspect of the invention in a schematic sectional representation.

In the device according to FIG. 2, the device according to FIG. 1 is used as a starting point, but is supplemented by additional components:

After the apparatus for the first printing process with the inkjet printer units C, M, Y and K there is a further inkjet printer unit AD 1, which prints a UV-curable adhesive on the strip B. This adhesive comprises a polyfunctional alkoxylated or a polyalkoxylated acrylate monomer (80 to 95 percent by weight) and a photoinitiator (1 to 15 percent by weight). A dye (for example in a proportion of between 1 and 10 percent by weight) can also additionally be added.

Figure 9:
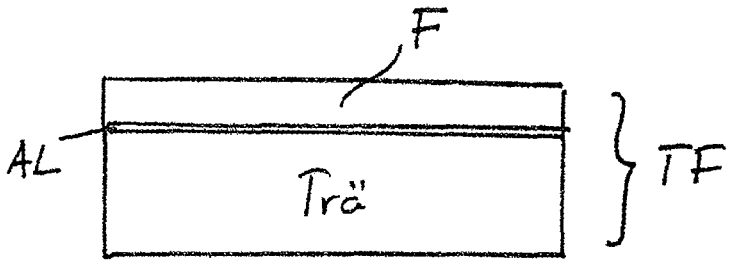
FIG. 9 shows the structure of a transfer film.

An apparatus 10 is arranged downstream of the inkjet printer unit AD 1. It is an apparatus for applying a transfer coating F to the strip B. A transfer film TF shown in detail in FIG. 9 is used, which transfer film has a carrier film Trä to which a transfer layer, which corresponds to the transfer coating F named here, is detachably fixed by the provision of a detachment layer AL. Thus, by means of a transfer method, the transfer coating is detached from the carrier film and applied to the strip B, in particular by means of a UV-curable adhesive. The carrier film Trä is in particular a film made of polyethylene terephthalate (PET), polycarbonate, or BOPP, ABS, PE, PP with a thickness of between 6 μm and 250 μm. The transfer coating F has a thickness of between 100 nm and 2000 nm. The transfer film TF is unrolled from a supply roller VR, for example in the movement direction of the strip B. Where the transfer film TF with the transfer coating F comes into contact with the previously printed adhesive, ultraviolet radiation is applied with the aid of an ultraviolet lamp UV, with the result that the adhesive is cured. The transfer coating F thus now sticks to the strip B and the carrier film Trä can be peeled off and wound up on the residual film winding roller HR. In a subsequent step, a second adhesive or a second printing ink is then printed on by a further inkjet printer unit AD 2, namely on the transfer coating F. This adhesive or this second printing ink serves to effect the hold of the transfer coating F on the substrate S in succession.

Figure 3:
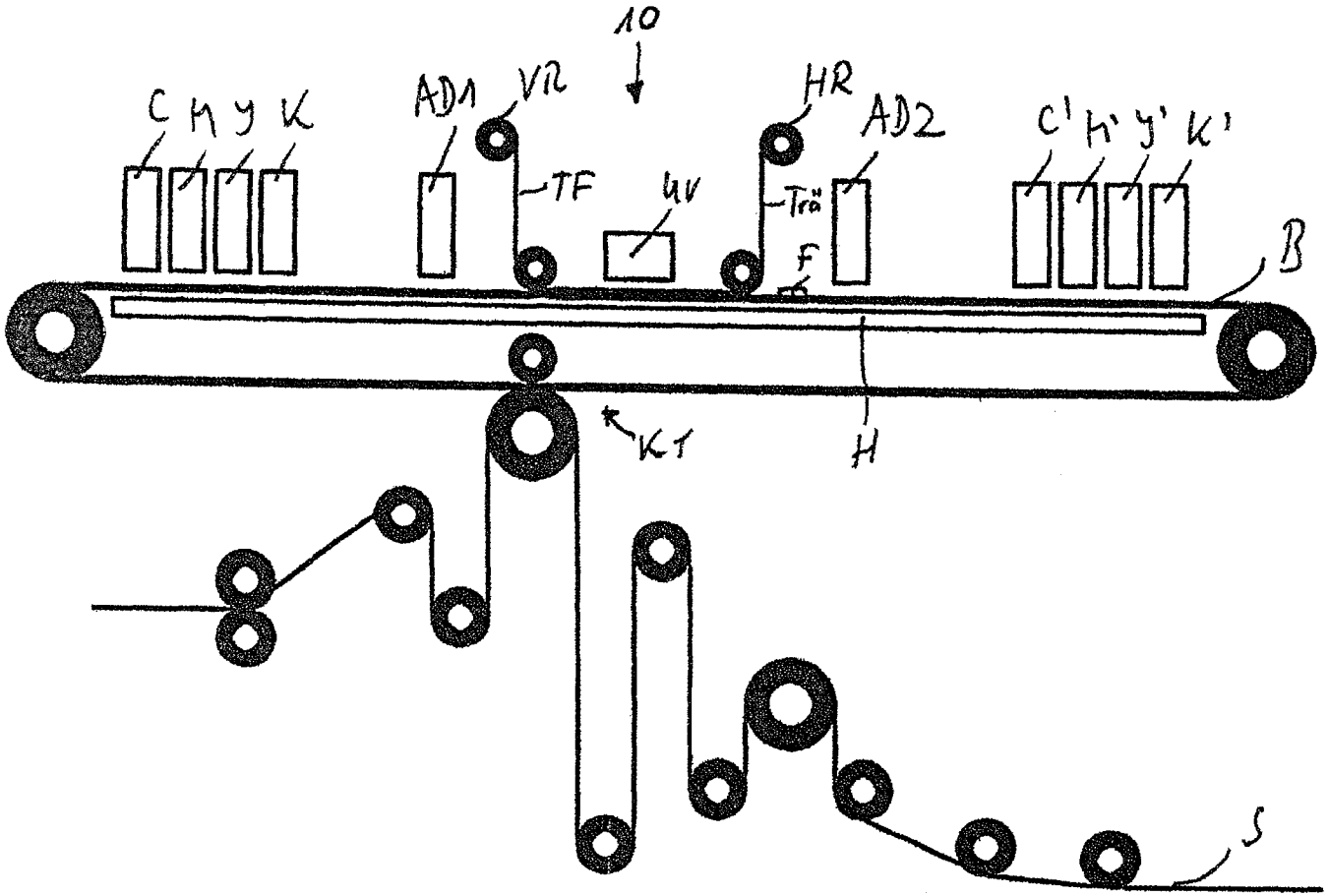
FIG. 3 shows a device for providing a substrate with an imprint according to a second aspect of the invention in a schematic sectional representation.

In a modification of the embodiment according to FIG. 2, in the embodiment according to FIG. 3 a second group is provided, after the inkjet printer unit AD 2, again with four inkjet printer units C', M', Y', K' which print the same colors as the inkjet printer units C, M, Y and K. The second group of inkjet printer units can, however, also print other colors, for example special colors in particular from the HKS color system or the Pantone® color system.

In a further modification it could also be provided that solely the inkjet printer units C', M', Y', K' are provided to print printing ink, thus not the inkjet printer units C, M, Y and K.

Figure 4:
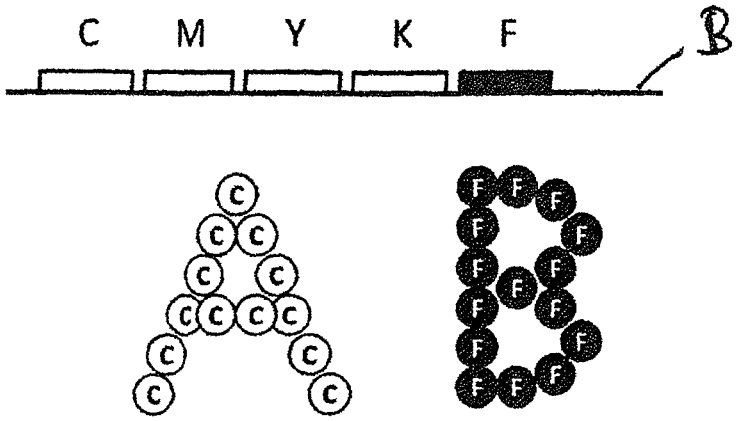
FIG. 4 shows how transfer coating parts can be provided next to dried printing ink.
Figure 5:
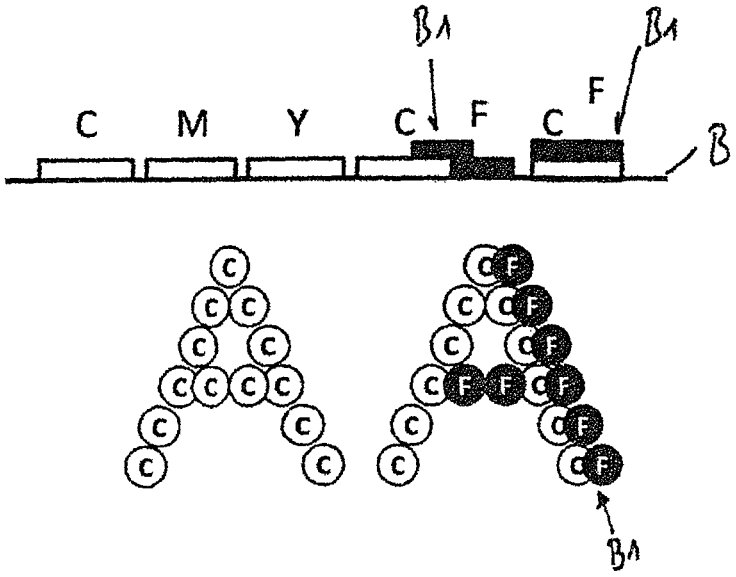
FIG. 5 shows how transfer coating parts can be arranged at least partially on dried printing ink.

The devices according to FIGS. 2 and 3 can be used to achieve printed images such as represented in FIGS. 4 and 5.

Firstly the transfer coating F can be arranged on the substrate S next to dots with printing ink from the inkjet printer units C, M, Y, K in the corresponding colors. The areas marked "C" in the lower part of FIG. 4, in which printer ink is provided, do not overlap with the areas labeled "F" for "transfer coating", in which the transfer coating is provided.

In the embodiment according to FIG. 5, in contrast, the transfer coating F is partially applied to areas which have been printed beforehand with printing ink. In particular there are overlap areas B1 in which the transfer coating F is applied to dots of printing ink. This relates to the situation on the strip B. On the substrate S the situation is exactly reversed, i.e. the transfer coating F is located partially underneath the printer ink and therefore forms a background area.

Figure 6:
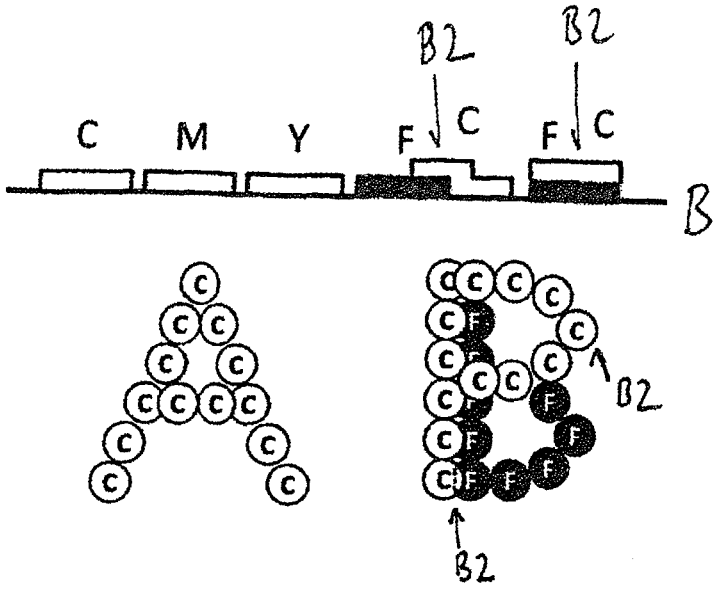
FIG. 6 shows how dried printing ink can be arranged at least partially on transfer coating parts.
Figure 7:
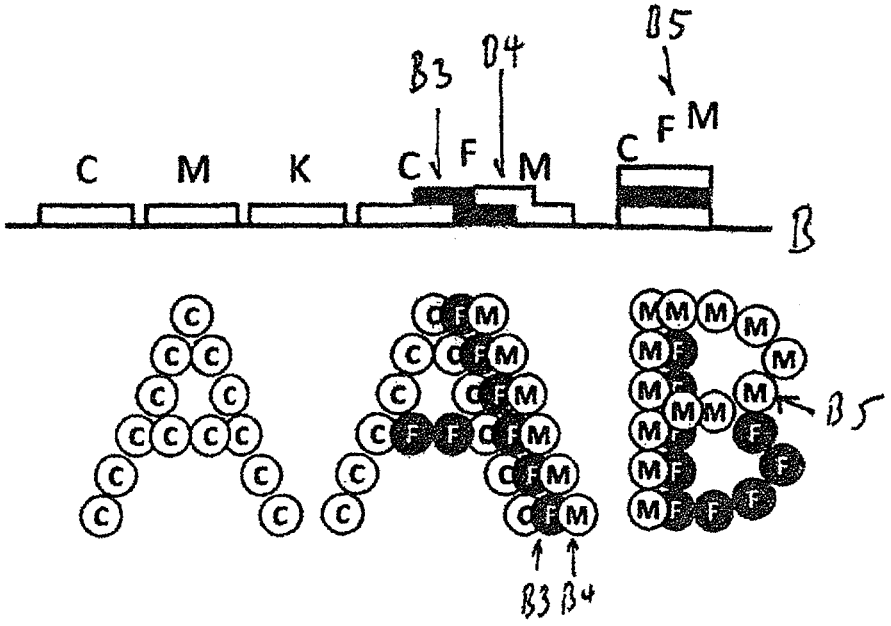
FIG. 7 shows how transfer coating parts can be arranged at least partially on dried printing ink and dried printing ink in turn on the transfer coating parts.

With the device according to FIG. 3 an image as shown in FIGS. 6 and 7 can be achieved:

Here transfer coating on the strip B is located underneath printing ink C in areas B2. On the substrate later the situation is reversed: the printing ink C is located underneath the transfer coating F, with the result that the transfer coating F protects the printing ink C in the area B2.

The image according to FIG. 6 can optionally also be implemented without the inkjet printing units C, M, Y, K.

The complete device according to FIG. 3 is needed to bring about an image according to FIG. 7:

Here there are areas B3 in which the transfer coating F on the strip B is located on printing ink C. There are areas B4 in which printing ink M is located partially on a part of the transfer coating F. Finally there are areas B5 in which the transfer coating F is located between two layers of printing ink, C and M. Depending on the opacity of the transfer coating F and the printing inks, different, additional optical effects or also additional functional properties can be achieved by the respective showing through, i.e. partial visibility, of the layer lying underneath in each case.

With reference to the plurality of achievable images according to FIGS. 4 to 7 it becomes clear what new possibilities are provided by the invention.

In the embodiments according to FIGS. 2 and 3 the apparatus 10 for applying a transfer coating is located directly in the area of the strip B, with the result that the transfer coating is applied to the strip.

Figure 8:
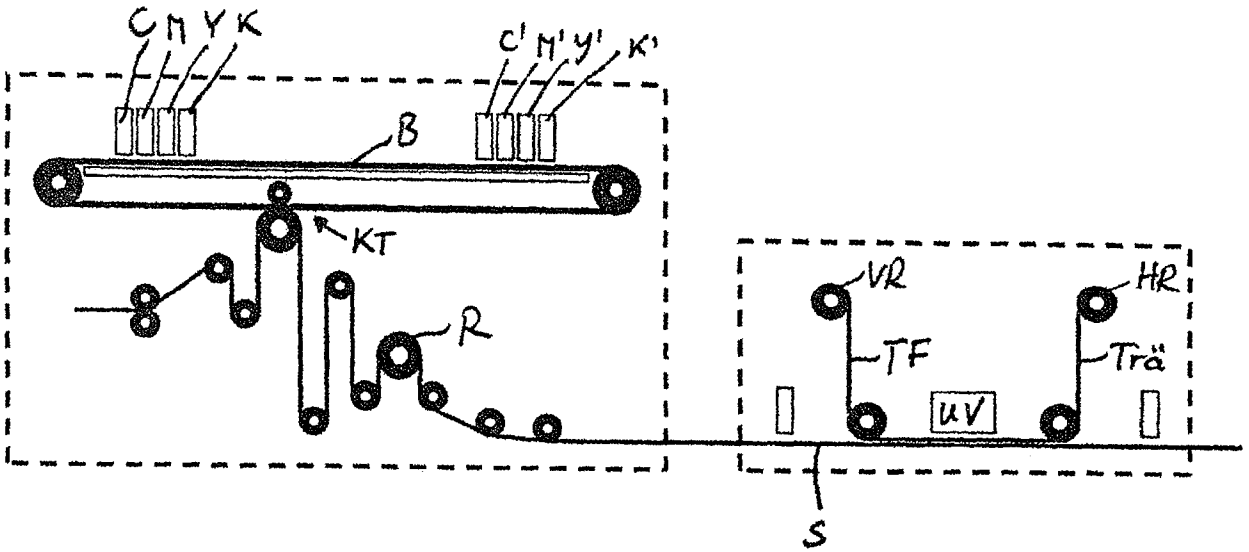
FIG. 8 shows a device for providing a substrate with an imprint according to a further embodiment in a markedly schematic sectional representation.

Likewise, it is also possible to arrange such an apparatus 10' for applying transfer coating according to FIG. 8 in the area of a supply of the substrate S, with the result that the substrate S is coated directly with the transfer coating F, optionally after the supply of adhesive from an inkjet printer unit AD 3 and when the adhesive is cured in the area of the application of the transfer coating F to the substrate S. The thus-obtained substrate is then fed to the contact point KT of the device in an uninterrupted (inline) process. The printing ink is transferred there. The embodiment according to FIG. 8 can be combined with the embodiments according to FIGS. 2 and 3, with the result that at one time transfer coating F is applied directly to the substrate S and then transfer coating which is later additionally transferred to the substrate S is also applied to the strip B at the same time.

LIST OF REFERENCE NUMBERS

AD 1 Inkjet printer unit
AD 2 Inkjet printer unit
AD 3 Inkjet printer unit
B Strip
B1 Areas
B2 Areas
B3 Areas
B4 Areas
B5 Areas
C Inkjet printer unit
C' Inkjet printer unit
F Transfer coating
H Heating loop
HR Residual film winding roller
K Inkjet printer unit
K' Inkjet printer unit
KT Contact point
M Inkjet printer unit
M' Inkjet printer unit
R Rollers
S Substrate
TF Transfer film
Trä Carrier film
UV UV lamp
VR Supply roller
Y Inkjet printer unit
Y' Inkjet printer unit
10 Apparatus for applying a transfer coating
10' Apparatus for applying a transfer coating

The invention claimed is:

1. A method for providing a substrate with an imprint, the method comprising:
- printing a liquid printing ink on a strip;
- allowing the printing ink to at least partially dry on the strip;
- detaching a transfer film from a carrier film;
- applying the transfer film to the strip to form a transfer coating on the strip; and
- transferring the at least partially dried printing ink and the transfer coating from the strip to the substrate.

2. A method according to claim 1, in which a curable adhesive is printed on the strip, with the result that the transfer film is then applied to the adhesive and the adhesive is cured.

3. A method according to claim 2, in which a further layer of adhesive is applied to the transfer coating.

4. A method according to claim 2, in which the adhesive has a polyfunctional alkoxylated or a polyalkoxylated acrylate monomer and a photoinitiator.

5. A method according to claim 1, in which the transfer film is applied to the strip after a first printing process in which printing ink is printed on the strip.

6. A method according to claim 5, in which the transfer film is applied next to the printing ink.

7. A method according to claim 5, in which the transfer film is applied such that it covers the printing ink in first areas.

8. A method according to claim 1, in which the transfer film is applied to the strip before a second printing process in which printing ink is printed on the strip.

9. A method according to claim 8, in which, in the second printing process, the printing ink is printed next to the transfer coating.

10. A method according to claim 8, in which, in the second printing process, the printing ink is printed such that it covers the transfer coating in second areas.

11. A method according to claim 1, in which the transfer coating is applied to the substrate before the transfer of the printing ink.

12. A method according to claim 11, in which, in a continuous process, the transfer coating is applied to the substrate and the substrate is guided to the strip, where the at least partially dried printing ink is transferred.

13. A method according to claim 1, in which the transfer coating contains a metallic layer or another electrical functional layer.

14. A method according to claim 1, in which the transfer coating contains one or more optical functional layers.

15. A device for providing a substrate with an imprint, the device comprising:
- a strip;
- an apparatus for printing liquid printing ink on the strip;
- an apparatus for detaching a transfer film from a carrier film and applying the transfer film to the strip to form a transfer coating on the strip; and
- an apparatus for guiding the substrate to the strip in order to transfer the printing ink and the transfer coating from the strip to the substrate.

16. A device according to claim 15, in which the apparatus for applying a transfer coating comprises:
- an apparatus for printing a first UV-curable adhesive on the strip, and/or
- a film-feeding apparatus and/or a residual film winding apparatus, and/or
- a UV lamp or another energy-rich radiation source for curing the first adhesive, and/or
- an apparatus for printing a second UV-curable adhesive on the strip.

17. A device according to claim 15, wherein the apparatus for detaching a transfer film from a carrier film and applying the transfer film to the strip to form a transfer coating on the strip is disposed upstream of the apparatus for guiding the substrate relative to a transport direction of the substrate.

18. A device according to claim 17, in which the strip can be heated in order to effect an at least partial drying of the printing ink.

19. A substrate provided with an imprint produced by the method according to claim 1, wherein the substrate at least partially comprises a a decorative transfer coating.

20. A substrate according to claim 19, in which printing ink is located on and/or under the transfer coating.

21. A substrate according to claim 19, in which the transfer coating comprises a decorative layer, a metallic layer and/or another electrical functional layer and/or one or more optical functional layers.

22. A device according to claim 15, in which the strip can be heated in order to effect an at least partial drying of the printing ink.

* * * * *